US005676231A

United States Patent [19]

Legras et al.

[11] Patent Number: 5,676,231

[45] Date of Patent: Oct. 14, 1997

[54] ROTATING BILL ACCEPTOR

[75] Inventors: Jean Pierre Legras; Charles J. Schmucker; Joseph R. Hedrick, all of Reno, Nev.

[73] Assignee: International Game Technology, Reno, Nev.

[21] Appl. No.: 584,262

[22] Filed: Jan. 11, 1996

[51] Int. Cl.[6] ..... G07F 7/04

[52] U.S. Cl. ..... 194/206; 195/350

[58] Field of Search ..... 194/206, 207, 194/350; 232/15, 16

[56] References Cited

U.S. PATENT DOCUMENTS 5,515,959 5/1996 Stephenson et al. ..... 194/206

OTHER PUBLICATIONS

Product Brochure "Player's Edge–Plus Slant Top," International Game Technology (published prior to Oct. 1995).

Product Brochure "Winner's Choice 19" Gaming," International Game Technology (published prior to Oct. 1995).

Product Brochure "Players Choice Drop–In Bar and Slant–Top," International Game Technology (published prior to Oct. 1995).

Product Brochure "S–Plus Imbedded Bill Acceptor Series," International Game Technology (published prior to Oct. 1995).

Product Brochure "S–Plus Slant Top," International Game Technology (published prior to Oct. 1995).

Product Brochure "Bingo with Built–In Bill Acceptor," International Game Technology (published prior to Oct. 1995).

Product Brochure "Side–Mounted Bill Acceptor for S–Plus and Players Edge–Plus Machines," International Game Technology (published prior to Oct. 1995).

Product Brochure "Player's Edge–Plus with Imbedded Bill Acceptor," International Game Technology (published prior to Oct. 1995).

Brochure from Williams Gaming, Inc. for Quantum Video Poker Machine (publicly disclosed as of at least Oct. 1995) (published prior to Oct. 1995).

*Primary Examiner*—F. J. Bartuska

*Attorney, Agent, or Firm*—Hickman Beyer & Weaver

[57] ABSTRACT

A rotating bill acceptor mounted inside a currency accepting machine is disclosed herein. The bill acceptor includes a bill validator which accepts (or rejects) cash inserted by users of the machine and a secure cash box which stores the bills out of the machine users' reach. The entire bill acceptor is pivotally mounted on a bracket in the machine interior. During normal operation, the bill acceptor is positioned such that its bill validator portion extends through an opening in a locked door on the machine's housing. Thus, the bill validator is available to accept cash while the cash box is protected within the machine interior. When it becomes necessary to remove the cash collected by the bill acceptor, a collection worker unlocks the door on the machine's housing, thereby accessing a mechanism which allows the bill acceptor to rotate out of its normal position and into a position in which the cash box is accessible through the unlocked door. The collection worker may then replace the full cash box with an empty cash box.

34 Claims, 6 Drawing Sheets

FIG. 1
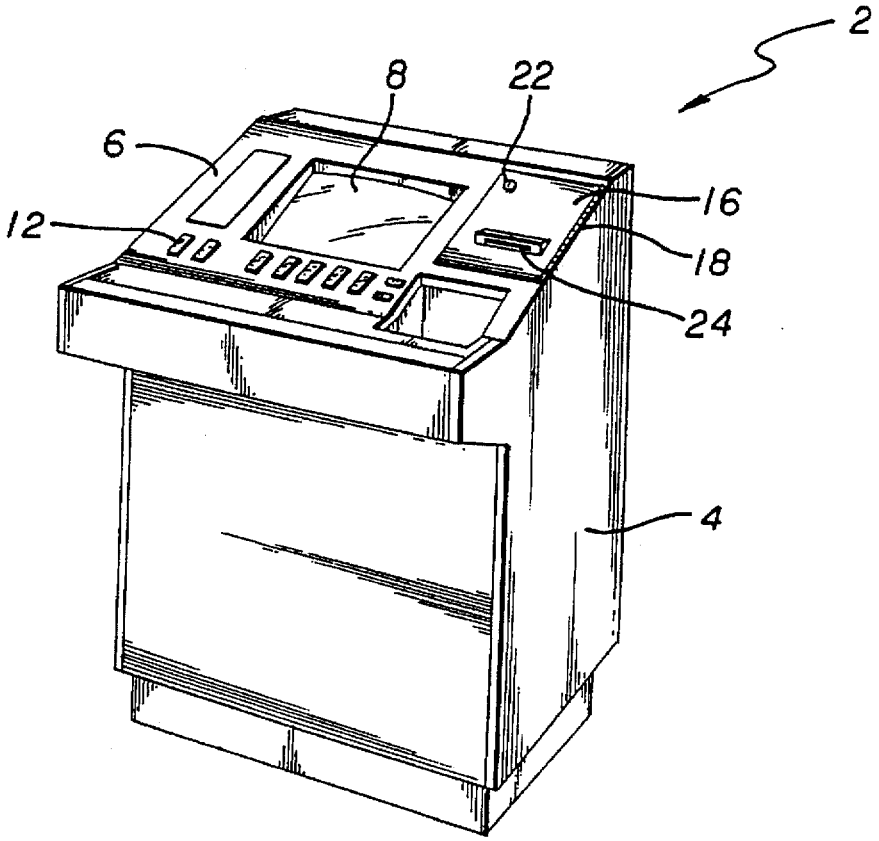
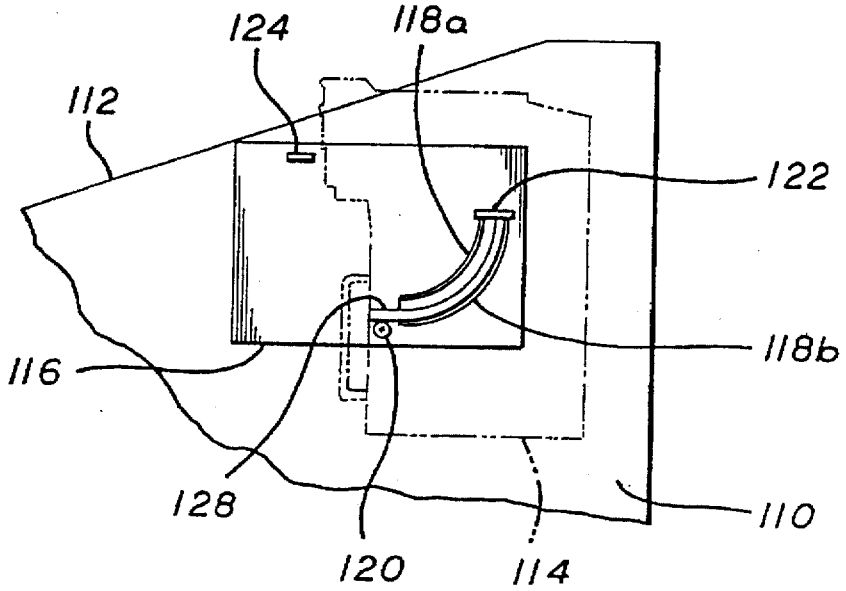
FIG. 6A

FIG.3A
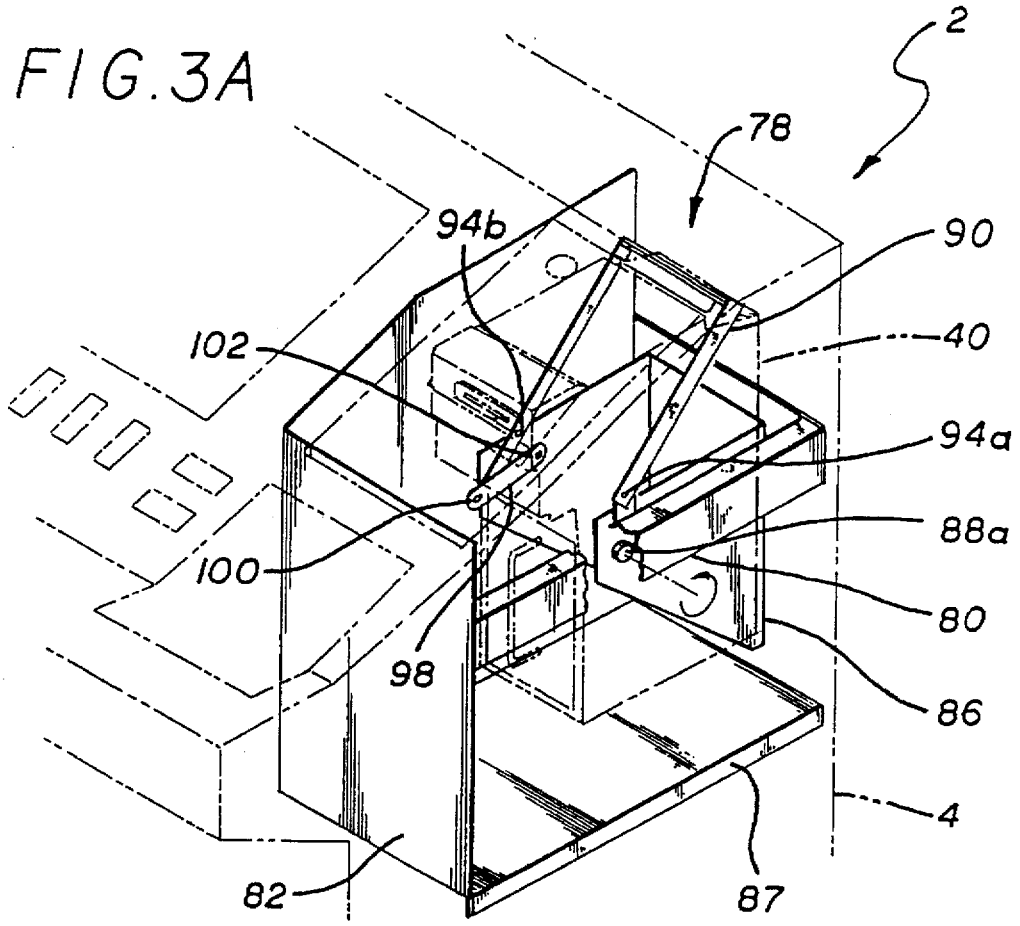
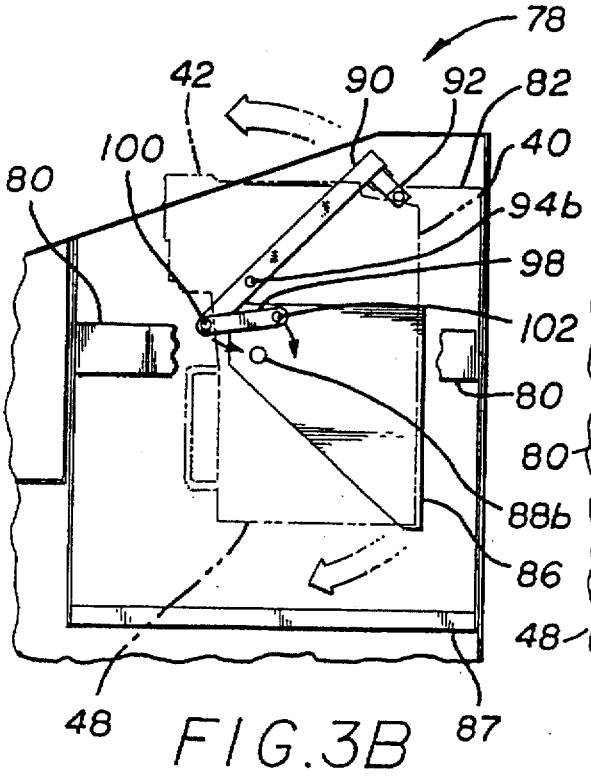
FIG.3B
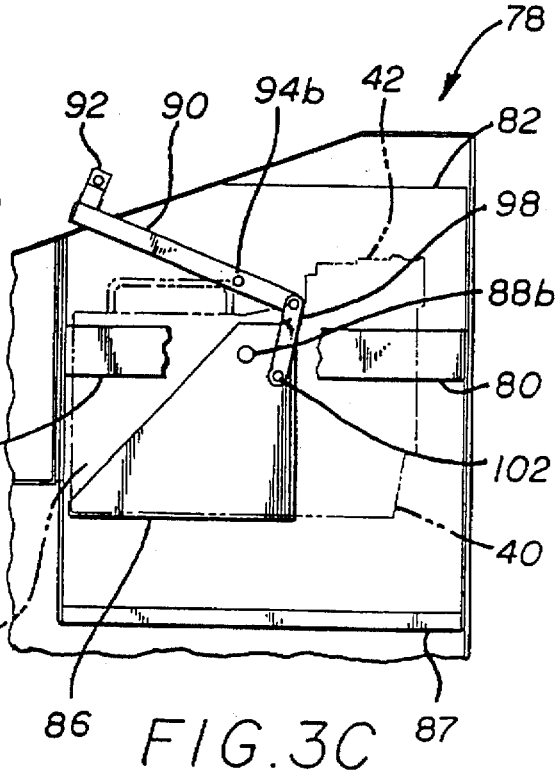
FIG.3C

FIG. 4A
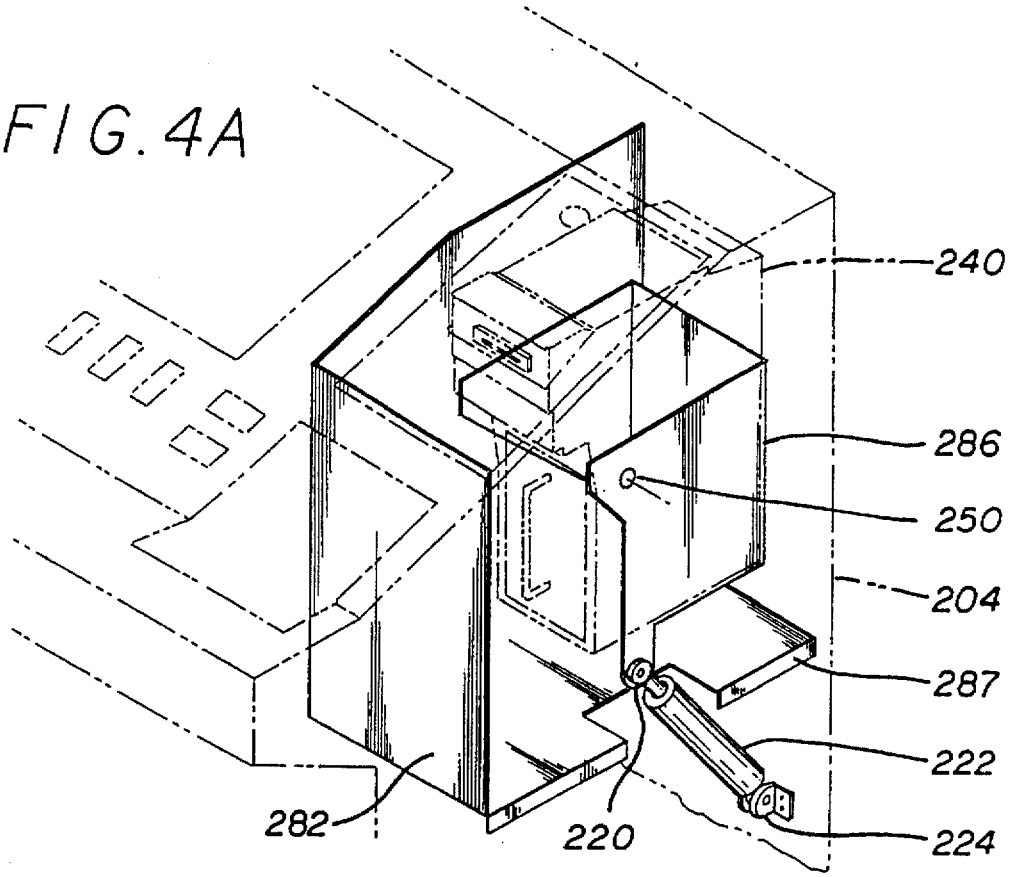
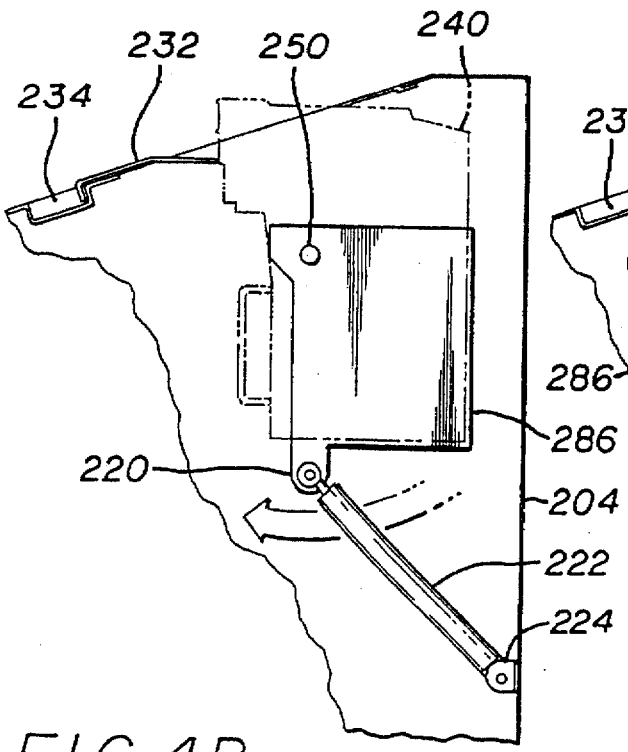
FIG. 4B
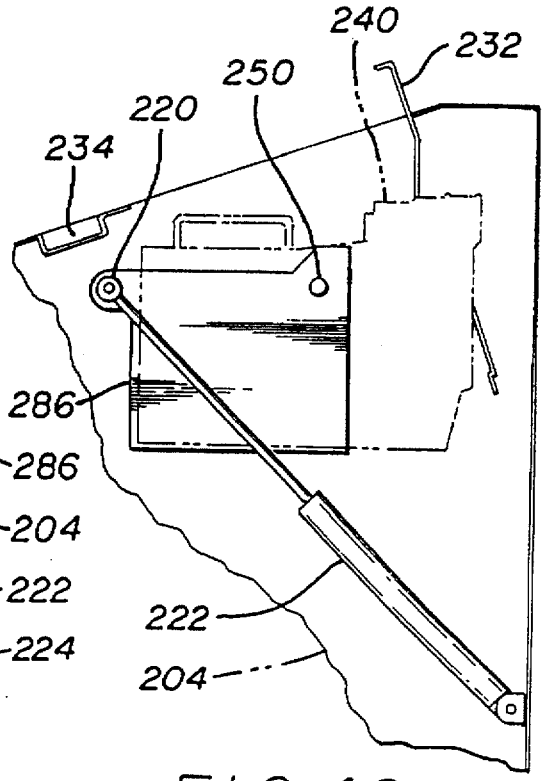
FIG. 4C

FIG.5A
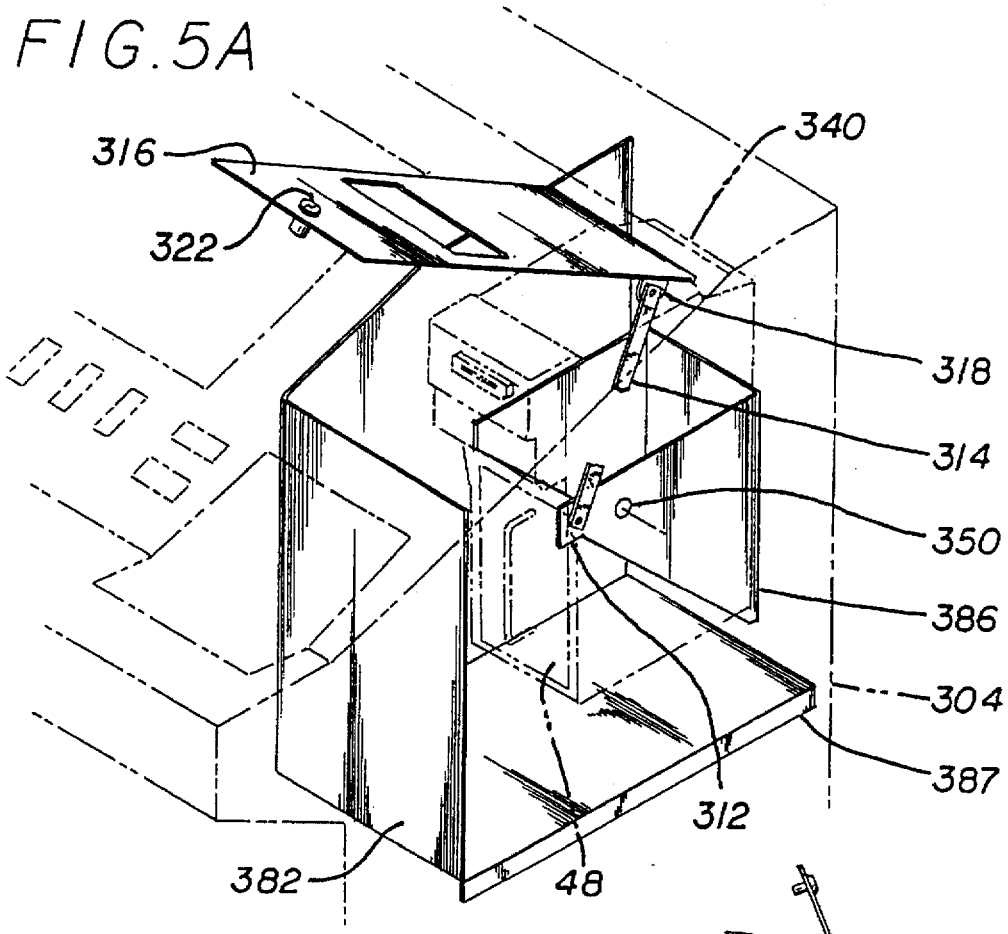
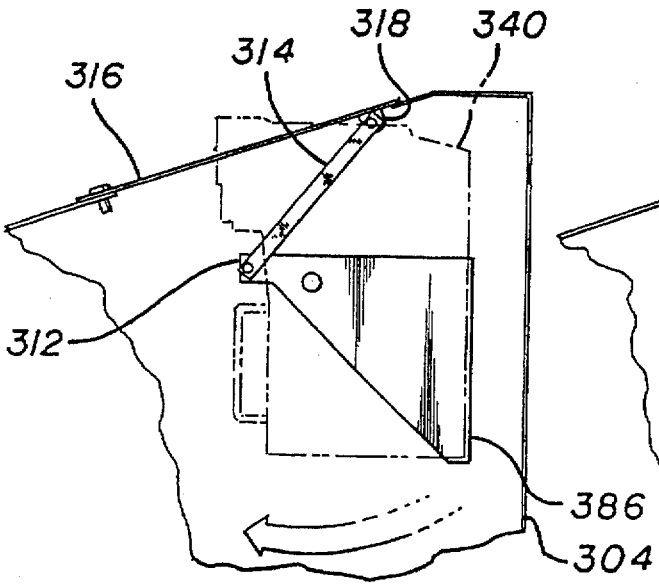
FIG.5B
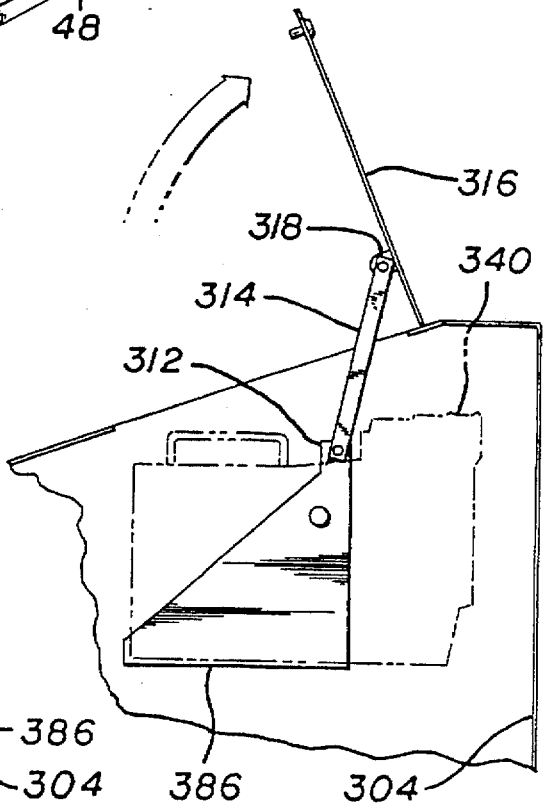
FIG.5C

FIG.6B
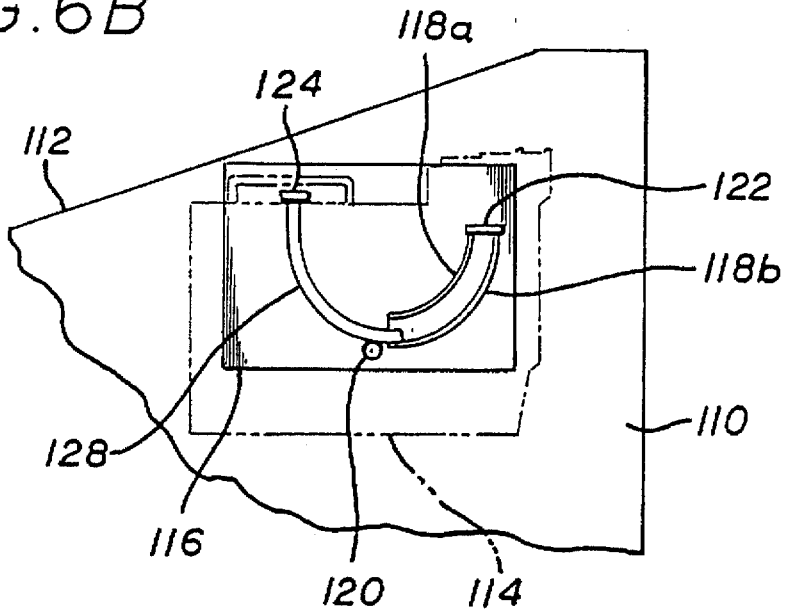
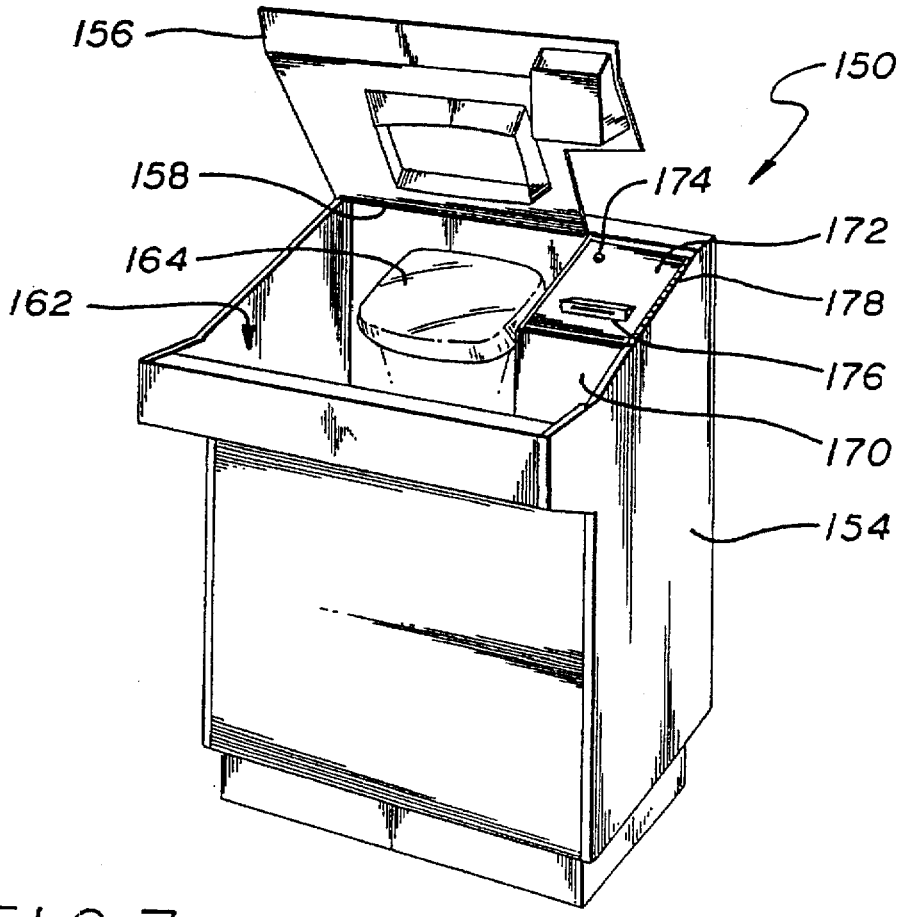
FIG.7

ROTATING BILL ACCEPTOR

BACKGROUND OF THE INVENTION

This invention relates to bill validators for currency accepting machines such as gaming machines. More particularly, the present invention relates to rotating bill validators that rotate between a bill insertion position in which a user can insert currency, and a cash removal position in which an attendant can remove a secure cash box from the validator.

There are a wide variety of currently available mechanisms for collecting paper currency. By way of example, one type of mechanism winds incoming bills onto a drum arrangement. Another type of mechanism essentially rams incoming bills into a bill receptacle without trying to arrange the bills in any order. Others contemplate stacking the incoming bills. As is well known to those skilled in the art, each of these types of mechanisms has its advantages and disadvantages.

Many machines now employ "bill acceptors" which arrange bills in a receptacle that may only be accessed by opening the bill acceptor itself. Periodically, collection personnel must unlock and open the machine to access a bill acceptor/bill receptacle to remove the bills. While a basic version of this arrangement works well in applications where security is not a major issue, in certain industries, such as the gaming industry, special precautions must be taken. It is not uncommon for slot machines to store upwards of $20,000 between collection cycles.

As will be appreciated by those familiar with the gaming industry, bill acceptors have recently been added to a number of different gaming machines (such as slot machines, video poker machines, etc.). To maintain the necessary security, it has become increasingly common to store bills collected by a bill acceptor in a secure "cash box" (sometimes referred to as a "collection box") that can not be accessed by maintenance people working on the bill acceptor. In addition, it has become common in the industry to provide two dedicated cash boxes for each bill acceptor. The cash boxes are locked such that they may not be opened by the person responsible for collecting the cash boxes, unless that person has a key. Typically, the keys to the cash box are not given to the person collecting the cash box, but rather, are given to authorized personnel in a dedicated counting center. Thus, when a first one of the cash boxes is collected, a second empty one of the cash boxes is installed in its place and the first cash box is delivered to the counting center. In this manner, substantial security is provided.

One drawback of currently available secure bill acceptors for the gaming industry is that their cash boxes are located at the bottom of the acceptor apparatus, where they are difficult to access. Typically they require collection personnel to unlock and open a door on the base of the gaming machine and then dislodge the cash box from the body of the bill acceptor. Not only is this cumbersome for the collection personnel, but it provides access to all the inner workings of the gaming machine. Thus, it is quite possible that a collection worker could accidentally or maliciously tamper with various machine electronics and other sensitive instrumentation. Accordingly it would be desirable to provide a more convenient system for accessing bill acceptor cash boxes without providing unnecessary access to other machine components.

Further, bill acceptors often have been integrated into gaming machines at locations and in arrangements that are obtrusive or difficult for users to access. For example, in some machines, bill acceptors have been mounted in a large steel box on the side of the machine. In other designs, the bill acceptor has been mounted toward the back of the machine, out of the user's cone of sight (i.e., the region of the machine in the user's view when the user is focusing on the machine display). In such machines, the user must look up from the game display and then reach toward the back of the machine to insert the bill. In some cases, this causes the user to lose interest in the game prematurely. Accordingly, gaming machines having the bill acceptor mounted in an accessible and unobtrusive location generally have wide appeal to users.

SUMMARY OF THE INVENTION

The present invention meets the above-mentioned needs by providing a rotating bill acceptor mounted inside a currency accepting machine. During normal operation, the bill acceptor is positioned such that its bill validator portion extends through an opening in a locked door on the machine's housing. Thus, the bill validator is available to accept cash while the cash box is protected within the machine interior. This provides at least the same level of security as prior art systems during normal operation. When it becomes necessary to remove the cash collected by the bill acceptor, a collection worker unlocks the door on the machine's housing, thereby accessing a mechanism which allows the bill acceptor to rotate out of its normal position and into a position in which the cash box is accessible through the unlocked door. Thus, the collection worker can now replace the full cash box with an empty cash box. Thereafter, the worker rotates the bill acceptor back to its normal position and closes and locks the door. During this entire process, the collection worker never accesses the machine interior, thereby minimizing the possibility of damage to or tampering with the internal machine components.

One aspect of the present invention provides a currency accepting machine that generally can be characterized as including (1) a machine housing with an external surface accessible to users of the machine; and (2) a bill acceptor rotatably mounted to the housing. As described above, the bill acceptor should include (a) a bill validator for receiving cash from machine users, and (b) a cash collection region (e.g., a cash box) for storing cash inserted by the users. Further as noted, the bill acceptor can rotate between two positions: (i) a bill insertion position in which the bill validator is accessible through the machine housing external surface while the cash collection region is blocked from access by the external surface, and (ii) a cash removal position in which the cash collection region is accessible through the gaming machine external surface. In one embodiment, the bill acceptor is pivotally mounted on a bracket in the machine interior. Other, non-pivoting, rotational mounts may also be employed however. For example, the bill acceptor may be mounted on sliding or rolling brackets.

In preferred embodiments, a bill acceptor access door is mounted on the machine housing external surface. When the bill acceptor access door is in a closed position, the bill acceptor must be in the bill insertion position with the bill validator accessible to machine operators though an opening in the door. Further, only when the bill acceptor access door is in an opened position can the bill acceptor be rotated to assume the cash removal position. To prevent tampering with the machine during cash collection, the bill acceptor access door should be sized and located with respect to the bill acceptor such that when the access door is opened, the interior region of the machine housing is not accessible.

Further, as security is a major concern, various locks may be placed on the system. For example, the access door should have a lock. In addition, a lock should be placed on the bill acceptor to prevent unauthorized access to cash in the cash collection region. Still further, there may even be a lock to prevent the bill acceptor from rotating to the cash removal position without authorization. When such rotation lock is combined with an enclosure geometry that prevents access to the cash collection region, the lock on the bill acceptor may be unnecessary.

In preferred embodiments, the currency accepting machine is a gaming machine such as a slot machine or a video poker machine. In one such embodiment, the machine housing includes a slant top which slants upward toward the rear of the housing, and includes a bill acceptor access door of the type just described. Such designs can provide the bill validator head at a location on the machine that is conveniently located within the players' cone of vision, thus helping to maintain player interest in the game. Preferably, the slant top includes a hinged slant top door that can be opened to access the machine interior for repairs and routine maintenance. To maintain security, such slant top door should be separate from the bill acceptor access door so that the access door can remain closed and locked while slant top door is opened for maintenance, etc.

Another aspect of the invention provides a method for accessing the cash collection region of a rotating bill acceptor having the above-described structure. The method may be characterized as including the following steps: (1) rotating the bill acceptor from a bill insertion position in which a bill validator is accessible through the machine housing external surface to a cash removal position in which the cash collection region is accessible through the machine housing external surface; and (2) accessing the cash collection region. Of course, the cash collection region may automatically become accessible upon rotation of the bill acceptor. Typically, the person performing this method will replace a full cash box (which has been collecting cash for the bill acceptor) with an empty cash box. Also, before the step of rotating, the worker typically must unlock and open the bill acceptor access door and engage a rotation mechanism.

These and other features of the present invention will be presented in more detail in the following detailed description of the invention and the associated figures.

BRIEF DESCRIPTION OF THE DRAWINGS

FIG. 1 is a perspective drawing of a slant top gaming machine having a bill acceptor.

FIG. 3A is a perspective drawing showing a pivotal rotation mechanism employed to rotatably mount a bill acceptor to a machine housing in accordance with a first preferred embodiment of the present invention.

FIG. 3B is a side sectional view of the rotation mechanism of FIG. 3A in a bill insertion position.

FIG. 3C is a side sectional view of the rotational of 3A in a cash removal position.

FIG. 4A is a perspective drawing showing a pivotal rotation mechanism employed to rotatably mount a bill acceptor to a machine housing in accordance with a second preferred embodiment of the present invention.

FIG. 4B is a side sectional view of the rotation mechanism of FIG. 4A in a bill insertion position.

FIG. 4C is a side sectional view of the rotation mechanism of FIG. 4A shown in a cash removal position.

FIG. 5A is a perspective drawing showing a pivotal rotation mechanism employed to rotatably mount a bill acceptor to a machine housing in accordance with a third preferred embodiment of the present invention.

FIG. 5B is a side sectional view of the rotation mechanism of FIG. 5A in a bill insertion position.

FIG. 5C is a side sectional view of the rotation of FIG. 5A shown in a cash removal position.

FIG. 6A is a side sectional view of a bill acceptor in a bill insertion position in in which a rail-based rotation mechanism is provided to direct rotation.

FIG. 6B is a side sectional view of the bill acceptor of FIG. 6A in a cash removal position FIG. 7 is a perspective view of a slant top gaming machine having a slant top door in an open position in accordance with a preferred embodiment of the present invention.

DESCRIPTION OF THE PREFERRED EMBODIMENTS

Figure 2A:
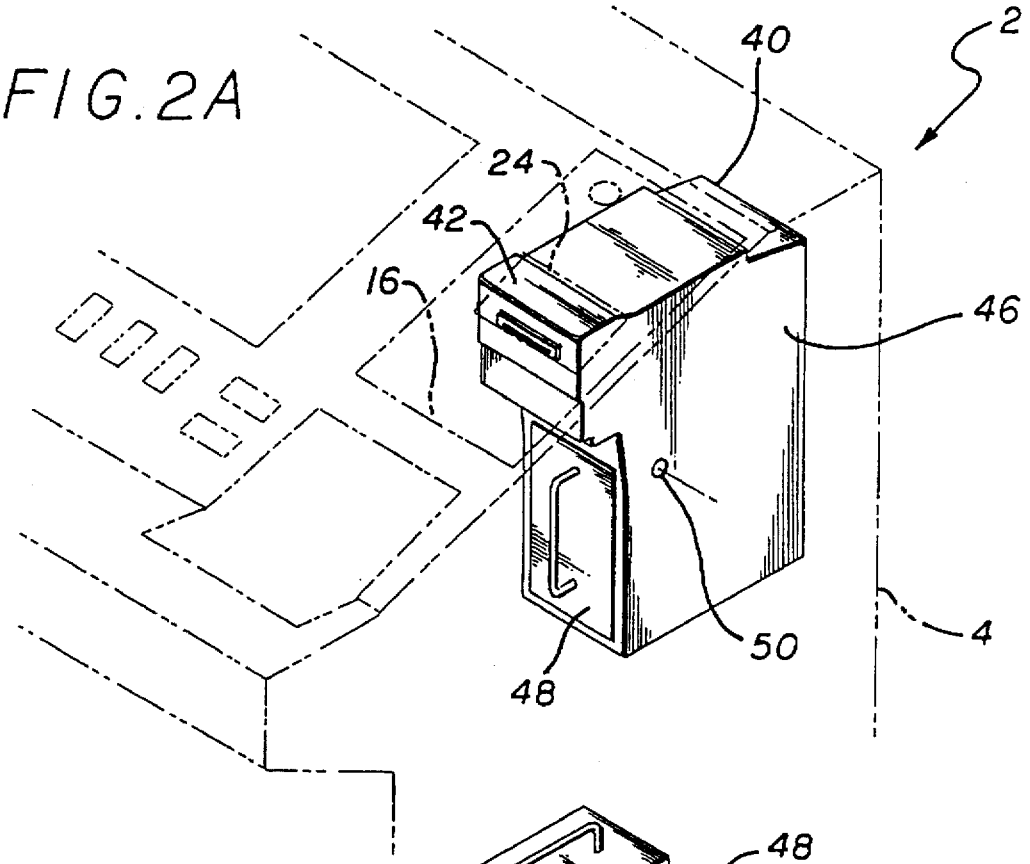
FIG. 2A is a cut away perspective drawing of a gaming machine having a rotating bill acceptor that can rotate between a bill insertion position (shown) and a cash removal position.

Turning first to FIG. 1, a slant top gaming machine 2 of the present invention is shown. Machine 2 includes a housing 4 which generally surrounds the machine interior (not shown) and is viewable by users. The housing includes a slant top surface 6 which slants from the front toward the back of the housing 4 at an angle of between about 10° and 60°, and more preferably between about 20° and 30°. Viewable through the slant top is a video display monitor 8 and a series of control buttons 12. The display monitor 8 will typically be a cathode ray tube, high-resolution flat panel LCD, or other conventional electronically controlled video monitor. The control buttons 12 allow the gaming machine user to select various games and/or game options. Many possible games including traditional slot games, progressive slot games, video poker, lottery, and increasingly popular multi-line machines which have multiple (e.g., 8 or 15) pay lines may be provided with gaming machines of this invention. Of course, the arrangement and function of control buttons 12 will depend somewhat upon the type of game (or games) that can be played on machine 2. In place of video monitor 8, a set of spinning reels may be placed behind the slant top. These spinning reels are typically stepper motor driven reel assemblies that each include a plurality of indicia on their periphery. If the indicia on the reels lineup in a predetermined spinning pattern, the player is paid a jackpot.

Provided on slant top surface 6 is a bill acceptor access door 16 which is connected to the remainder of slant top surface 6 by a hinge 18. When access door 16 is opened, a bill acceptor (not shown in this Figure) will be accessible. To prevent unauthorized access to the bill acceptor, access door 16 includes a lock 22.

When a user wishes to play the gaming machine 2, he or she inserts cash through a bill insertion slot 24 on door 16. The bill insertion slot 24 preferably is provided as a thin molded plastic covering having a bill-sized slot in communication with the bill acceptor located behind the door 16. To remain fairly unobtrusive and to make the bill acceptor appear as an integrated component of gaming machine 2, the slot covering preferably will not extend more than about 5 cm, and more preferably not more than about 2 cm, beyond the plane of door 16. Further, the slot 24 should be provided within the user's "cone of vision" (i.e., the user's field of vision when focused on video display 10). This makes the user feel more comfortable and therefore more likely to continue using the machine for long periods of time.

Figure 2B:
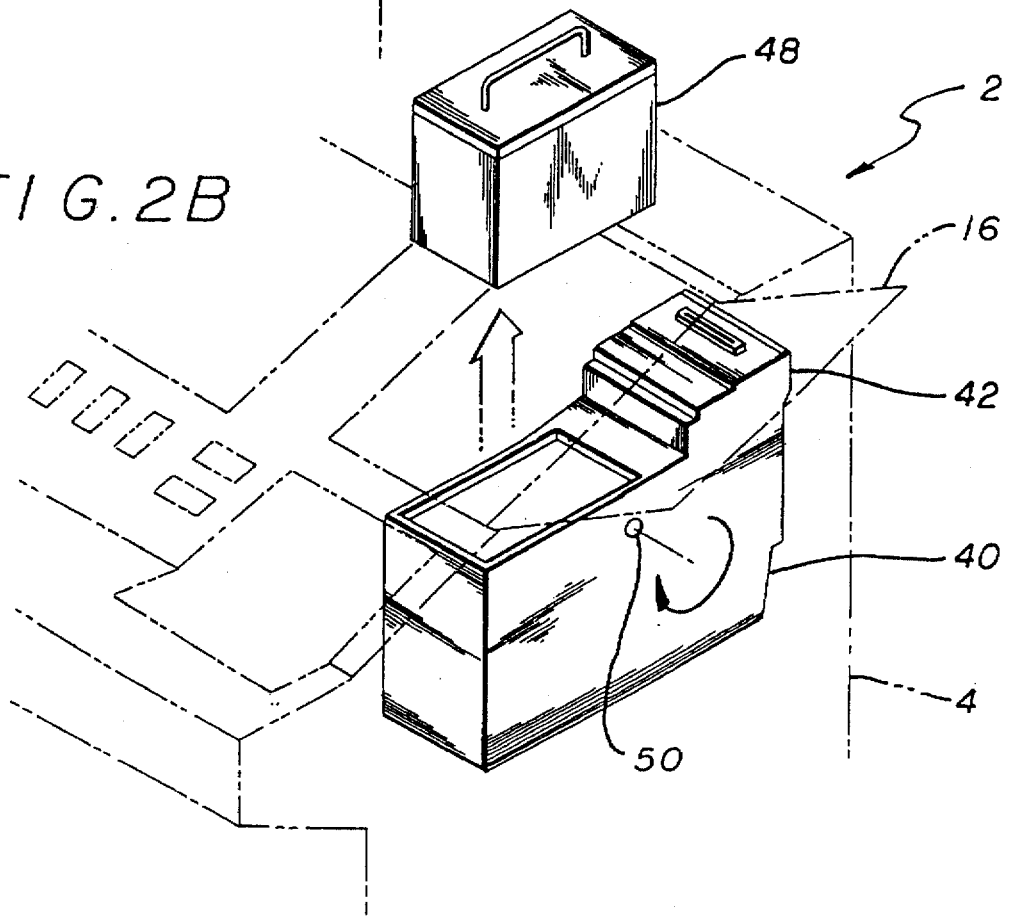
FIG. 2B is a cut away perspective drawing of the machine shown in FIG. 2A, but with the rotating bill acceptor rotated to a cash removal position.

FIGS. 2A and 2B show perspective cut away views of the gaming machine 2 of FIG. 1. FIG. 2A illustrates a generally "L-shaped" rotating bill acceptor 40 in an orientation associated with normal use, referred to herein as the bill insertion position. In this position, a bill validator portion 42 of bill acceptor 40 is located adjacent to the bill acceptor access door 16 such that a bill receptacle on the validator coincides with the position of the bill insertion slot 24 on access door 16. The bill validator 42 includes various detectors and associated electronics/logic to optically and magnetically verify that bills inserted into the gaming machine are indeed valid bills (i.e., the bills are not counterfeit). Many makes and models of bill validators are commercially available, and may be used with the present invention in either an unmodified or slightly modified form. By way of example, bill validators are available from Rowe International of Whippany, N.J., Japan Cash Machine Co., LTD. of Osaka, Japan, Mars Electronics, Inc. of West Chester, Pa., and Dixie Narco, Inc. of East Lake, Ohio.

In addition to the bill validator portion, the bill acceptor 40 also includes a transport portion 46 which moves validated bills from the bill validator 42 to a cash box 48 where validated bills are stored. The bill acceptor 40 is pivotally mounted to the interior of machine 2 at two pivot points including arbitrary point 50 shown in FIG. 2A. In some embodiments, a single pivot shaft may be employed off of one side. Note that when bill acceptor 40 is in the bill insertion position, cash box 48 is located within the gaming machine's interior, away from the access door 16.

When cash box 48 is to be removed during a collection cycle, a collection worker first unlocks and opens door 16 to gain access to bill acceptor 40. At that point, the cash box is still inaccessible. Thus, the collection worker must rotate bill acceptor 40 about an axis provided through pivot point 50 so that the bill validator portion 42 tilts to the back of machine 2 and cash box 48 is presented at the doorway as shown in FIG. 2B. This position is referred to herein as the cash removal position (or cash box removal position for those embodiments employing a cash box), and is characterized as being the position in which collection workers can retrieve cash or a cash box from the bill acceptor (as shown by the arrow in FIG. 2B). Various mechanisms may be provided to rotate the bill acceptor, and three preferred mechanisms will be described with reference to FIGS. 3A–C, 4A–C, and 5A–C.

Upon rotating the bill acceptor 40 to the cash box removal position, the collection worker can remove the cash box 48 as shown in FIG. 2B. In preferred embodiments, a lock will be provided to prevent rotation from the bill insertion to the cash removal position. In addition, as an extra or alternative security measure, cash box 48 may be locked to the remainder of bill acceptor 40 so that the only those individuals having the proper key can remove cash box 48. After the collection worker has removed the full cash box 48, he or she will typically replace it with an empty cash box, which will remain in place until the next collection cycle, and will rotate the bill acceptor 40 back to the original insertion position.

FIGS. 3A, 3B, and 3C show a first preferred rotation mechanism for holding the bill acceptor 40 (phantom lines) in place with respect to machine housing 4 (phantom lines), and also allowing the bill acceptor to rotate between the bill insertion and cash box removal positions. As shown, a rotation mechanism 78 includes an L-shaped bracket 80 for attaching to the right side of machine housing 4 and a three-sided bracket 82 which attaches to the L-shaped bracket 80. Bracket 82 also attaches to the right side of machine housing 4 via a thin sheet member 87. Together L-shaped bracket 80 and three-sided bracket 82 form a frame to hold bill acceptor 40 in place with respect to housing 4. Bill acceptor 40 is mounted in a cradle 86 which is in turn pivotally mounted to L-shaped bracket 80 at a pivot point **88*a* and to three-sided bracket 82 at a second pivot point 88*b* (not shown in FIG. 3A). In this manner, cradle 86 can rotate about an axis through pivot points 88*a* and 88*b***.

A handle 90 is pivotally mounted to L-shaped bracket 80 at a pivot point **94*a* and to three-sided bracket 82 at a pivot point 94*b*. Thus, handle 90 can be moved about an axis through pivot points 94*a* and 94*b*. The handle 90 is pivotally coupled to cradle 86 via a pivot arm 98. Specifically, handle 90 is pivotally connected to pivot arm 98 at a pivot point 100 and cradle 86 is pivotally connected to pivot arm 98 at pivot point 102. Handle 90 includes a release mechanism 92**, which when gripped and depressed, allows the handle to be rotated in the direction illustrated in FIG. 3B.

FIG. 3B presents a side sectional view of the rotation mechanism 78 as viewed from the L-shaped bracket 80 side but illustrating features on the bracket 82 side of cradle 86. As shown, the rotation mechanism 78 holds the cradle 86 (and as a consequence the bill acceptor 40) in the bill insertion position. FIG. 3C presents the same view but with the cradle 86 in the cash box removal position. As indicated by the arrows in FIG. 3B, when handle 90 is pulled forward toward the front of machine 2 (as by a collection worker), the pivot arm 98 is forced toward the back of machine 2, and cradle 86 is rotated clockwise when viewed from the bracket 80 side. By rotating the cradle 86 clockwise, the bill validator 42 is moved down and to the back of the machine, while the cash box 48 is moved up to the bill acceptor access door as shown in FIG. 2B.

FIGS. 4A, 4B, and 4C show a preferred rotation mechanism for holding a bill acceptor 240 (phantom lines) in place with respect to a machine housing 204 (phantom lines), and allowing the bill acceptor to rotate between the bill insertion and cash box removal positions. As shown, a three sided bracket (enclosure) 282 attaches to the right side of machine housing 204 via a thin sheet member 287. Three-sided bracket 282 in conjunction with housing 204 form (1) a frame to hold bill acceptor 240 in place, and (2) a secure enclosure for bill acceptor 240. Bill acceptor 240 is mounted in a cradle 286 which is in turn pivotally mounted to three-sided bracket 282. A mounting lug 220 is an integral feature of cradle 286. A spring loaded damper 222 is attached pivotally at one end to lug 220 and pivotally at the other end to a lug 224 on machine housing 204.

In this mechanism, a catch 232 solidly mounted to the rotating combination of components serves as both an access door and a handle. Thus, when a person opens and lifts the catch 232, the bill acceptor 240 automatically rotates from the bill insertion position to the cash removal position. The end of catch 232 mechanically engages a latch 234 mounted in a stationary position on housing 204. When latch 234 is actuated, it releases its mechanical engagement with a catch 232 and in turn allows the rotating combination of components to rotate about pivot point 250 in the direction as shown by arrow of FIG. 4B until it reaches the cash removal position as shown in FIG. 4C.

Spring loaded damper 222 provides the motivating force for rotation. By pushing downward on the catch 232, a collection worker can rotate the bill validator back into the bill insertion position where latch 234 will reengage mechanically with catch 232.

FIGS. 5A, 5B, and 5C show a third preferred rotation mechanism for holding the bill acceptor 340 (phantom lines) in place with respect to machine housing 304 (phantom lines), and also allowing the bill acceptor to rotate between the bill insertion and cash box removal positions. As in the previous embodiments, a three sided bracket (enclosure) 382 attaches to the right side of the machine housing 304 via a thin sheet member 387. Three sided bracket 382 in conjunction with housing 304 form (1) a frame to hold bill acceptor 340 in place, and (2) a secure enclosure for bill acceptor 340. Bill acceptor 340 is mounted in a cradle 386 which is in turn pivotally mounted to three sided bracket 382.

A mounting lug 312 connects a linkage mechanism 314 to a cradle 386. The linkage mechanism 314 is, in turn, connected by a mounting lug 318 to an access door 316. Thus, the linkage mechanism 314 is pivotally attached at one end to lug 312 and pivotally attached at the other end to lug 318.

When access door 316 is opened by unlocking a lock 322 and lifting upward, the rotating combination of components automatically rotate about pivot point 350 in the direction as shown by arrow in FIG. 5B until it reaches the cash removal position as shown in FIG. 5C. The linkage mechanism 314 transmits the motivating force manually applied to the door 316. Closing door 316 rotates the bill acceptor in the opposite direction thus repositioning it back into the bill insertion position.

FIGS. 6A and 6B illustrate an alternate preferred embodiment of the present invention. Specifically, FIGS. 6A and 6B present side sectional views of a rotating bill acceptor that rotates between a bill insertion position (FIG. 6A) and a cash removal position (FIG. 6B) by sliding on a curved rail 128. This should be contrasted with the pivot rotation mechanism described in the context of the FIGS. 3A–C, 4A–C, and 5A–C. In general, the rail-based mechanism exemplified in FIGS. 6A and 6B can be interchanged with the pivot point mechanisms in any of the above-described embodiments.

As in the pivot rotation embodiments described above, a bill acceptor 114 includes a bill validator, a bill transport, and a cash box. In addition, this embodiment employs a sliding bracket 116 mounted on machine housing 110. Bracket 116 is preferably a sheet (e.g. sheet metal) from which curved tracks **118*a* and 118*b* protrude inwardly. A roller 120 for moving rail 128 is provided at the end of track 118*b*. Bracket 116 also includes a rail stop 122 for blocking bill acceptor 114 from rotating beyond the bill insertion position and a rail stop 124 for blocking bill acceptor 114 from rotating beyond the cash removal position. Curved rail 128 is mounted on one side of bill acceptor 114 and engages curved tracks 118*a* and 118*b*** as shown.

In operation, a collection worker opens an access door on slant top 112 and rotates the bill acceptor between the bill retrievable position (FIG. 6A) and the cash removal position (FIG. 6B). The rotation may be accomplished as a separate step as required in the first embodiment (FIGS. 3A–3C) or automatically when the door opens as in the second and third embodiments (FIGS. 4A–5C). Regardless of how rotation is initiated, it causes rail 128 to move over roller 120 and along curved track **118*b* until stop 124 is reached. A second set of curved tracks (not shown) parallel to the first set of curved tracks 118*a* and 118*b* will be provided in the gaming machine interior at the opposite side of cash acceptor 114**.

It should be understood that the embodiments shown in FIGS. 3A through 6B present but two examples of rotating bill acceptors in accordance with this invention. It is of course possible that other rotatable configurations and mechanisms could be employed to affect the same result.

Sometimes slant top gaming machines such as those described herein are designed such that the slant top surface of the machine functions as a door which may be opened to access the video display and associated electronics for repairs and routine maintenance. Unfortunately, in conventional machines, the bill acceptor may also be exposed when the slant top door is opened. It would therefore be desirable to isolate the bill acceptor from the video display when maintenance is performed. Likewise, it would be desirable to isolate the video display from the bill acceptor when cash is collected from the gaming machine.

A preferred embodiment illustrated in FIG. 7 meets these criteria. As shown, a gaming machine 150 includes a machine housing 154 on which is mounted a slant top door 156 which swings open and closed on a hinge 158 at the top rear portion of housing 154. As shown in FIG. 7, the door 156 is an open position allowing access to machine interior 162 including a video monitor 164 or spinning reels (not shown). The bill acceptor, however, is not accessible as it is locked in an acceptor compartment 170 behind an access door 172 which is mounted to housing 154 by a hinge 178. As in the above-described embodiment, the access door 172 includes a lock 174 and a bill insertion slot 176. Slant top door 156 also should be provided with a lock requiring a different key than the access door lock 174. Thus, a maintenance worker may open the slant top door 156 to work on the video monitor or other internal machine components without gaining access to the bill acceptor. Additionally a cash collection worker can access the cash box without having access to the internal machine components.

Although the foregoing invention has been described in some detail for purposes of clarity of understanding, it will be apparent that certain changes and modifications may be practiced within the scope of the appended claims. For instance, the invention may be practiced with any of a number of possible machines which (1) provide credit to a user when the user inserts currency, and (2) dispense goods or services when the user issues appropriate instructions. By way of example, the host machine may be a vending machine such as a soda machine, a candy machine, or a cigarette machine, or an arcade game such as a video arcade game. In addition, the reader will understand that the bill acceptor structure described herein (including a bill validator, a transport, and cash box) may be replaced by various other bill acceptor structures which include some mechanism for accepting cash inserted by a user and a receptacle for temporarily storing the cash. In some cases, the bill acceptor can be shaped such that the rotating bill validator may used in non-slant top machines such as flat top "bar table" machines in which paper currency is inserted down through a slot in a horizontal top. Any arrangement will suffice so long as the cash receptacle is inaccessible until after an access door is opened and the bill acceptor structure is rotated.

What is claimed is:

1. A currency accepting machine comprising:

a machine housing having an external surface accessible to users of the currency accepting machine; and a bill acceptor rotatably mounted to said machine housing, said bill acceptor including a bill validator for receiving cash from machine users, and a cash collection region for storing cash inserted by the machine users, wherein the bill acceptor has at least (i) a bill insertion position in which the bill validator is accessible through the machine housing external surface while the cash collection region is blocked from access by the external surface, and (ii) a cash removal position, rotationally separated from the bill insertion position, in which the cash collection region is accessible through the machine housing external surface while the bill validator is blocked from access by the external surface.

2. The currency accepting machine of claim 1 wherein the bill acceptor is pivotally mounted for rotation between the bill insertion position and the cash removal position.

3. The currency accepting machine of claim 1 wherein the bill acceptor is mounted on a sliding bracket for rotation between the bill insertion position and the cash removal position.

4. The currency accepting machine of claim 1 further comprising a bill acceptor access door mounted on said machine housing external surface and having an opening, wherein when said bill acceptor access door is in a closed position and the bill acceptor is in the bill insertion position, the bill validator is accessible though said opening, and wherein when said bill acceptor access door is in an opened position, the bill acceptor can be rotated to assume the cash removal position.

5. The currency accepting machine of claim 4 wherein the bill acceptor access door includes a lock.

6. The currency accepting machine of claim 4 wherein the bill acceptor access door is sized and located with respect to said bill acceptor such that when said bill acceptor access door is opened, an interior region of the machine is not manually accessible.

7. The currency accepting machine of claim 4 wherein said machine housing includes a slant top which slants upward toward the rear of the housing, the slant top forming at least part of the currency accepting machine's external surface through which the bill validator is accessible when the bill acceptor is in the bill insertion position.

8. The currency accepting machine of claim 7, wherein the slant top is affixed to the remainder of the machine housing by hinges such that said slant top, but not including the bill acceptor access door, can be lifted to expose an interior region of the machine while the bill acceptor remains blocked by the bill acceptor access door.

9. The currency accepting machine of claim 4 further comprising:

a rotatable cradle for holding said bill acceptor, and a linkage mechanism connecting said access door to said cradle such that opening the access door causes the bill acceptor to rotate between said bill insertion and said cash removal positions.

10. The currency accepting machine of claim 4 further comprising:

a rotatably cradle for holding said bill acceptor, and a spring loaded damper connecting said cradle to said machine housing, wherein the access door is solidly mounted to said bill acceptor such that opening the access door causes the bill acceptor to rotate between said bill insertion and said cash removal positions.

11. The currency accepting machine of claim 1 wherein the cash collection region is a cash box having a lock.

12. The currency accepting machine of claim 1 further comprising a lock which prevents the bill acceptor from rotating between the bill insertion position and the cash removal position.

13. The currency accepting machine of claim 1 further comprising a bracket mounted to an interior of the machine housing, wherein the bill acceptor is pivotally mounted to the bracket such that when said bill acceptor access door is in the opened position, the bill acceptor may be rotated between the bill insertion position and the cash removal position.

14. The currency accepting machine of claim 1 wherein the machine is a gaming machine.

15. A method of accessing a cash collection region of a bill acceptor rotatably mounted in a currency accepting machine having an external surface, the method comprising the following steps:

rotating the bill acceptor from a bill insertion position in which a bill validator is accessible through the machine housing external surface while the cash collection region is blocked from access by the external surface, to a cash removal position in which the cash collection region is accessible through the machine housing external surface while the bill validator is blocked from access by the external surface; and accessing the cash collection region.

16. The method of claim 15 further comprising the following step, performed before said step of rotating:

opening a bill acceptor access door mounted on said machine housing external surface and having an opening through which the bill validator is accessible to operators of the currency accepting machine.

17. The method of claim 16 further comprising a step of unlocking the bill acceptor access door.

18. The method of claim 15 further comprising the following step, performed before the step of rotating:

unlocking the bill acceptor such that it can be rotated from the bill insertion position to the cash removal position.

19. The method of claim 15 wherein the cash collection region contains a cash box, and the method further comprises a step of replacing the cash box with an empty cash box.

20. The method of claim 15 wherein, in the step of rotating, the bill acceptor is rotated about a pivot mount on a bracket mounted to an interior surface of the currency accepting machine.

21. The method of claim 15 wherein the step of rotating comprises sliding the bill acceptor mounted in sliding brackets between the bill insertion position and the cash removal position.

22. The method of claim 15 wherein the step of rotating comprises pivoting the bill acceptor about a pivot mount such that the bill acceptor rotates between the bill insertion position and the cash removal position.

23. A currency accepting machine comprising:

a machine housing defining a machine interior and at least one machine exterior surface, the machine housing having a slant top surface which slants upward toward the rear of the housing;

a bill acceptor access door on the slant top surface, the access door having an opening for allowing cash insertion, and having a lock to prevent unauthorized opening;

a rotatable bill acceptor provided in the machine interior, the bill acceptor including a bill validator for validating bills inserted in the machine by users, and a cash box with a lock; and a rotation mechanism mounted to the machine interior and engaging said rotatable bill acceptor, such that the bill acceptor can rotate between at least (i) a bill insertion position in which the bill validator is accessible through the opening in the bill acceptor access door while the cash collection region is blocked from access by the external surface, and (ii) a cash removal position, rotationally separated from the bill insertion position, in which the cash box is accessible through the machine housing external surface while the bill validator is blocked from access by the external surface.

24. The currency collecting machine of claim 23 further comprising a lock on the bill acceptor which can prevent the cash box from being separated from the remainder of the bill acceptor.

25. The currency collecting machine of claim 23 further comprising a lock on the rotation mechanism to prevent unauthorized rotation of the bill acceptor to said cash removal position.

26. The currency accepting machine of claim 23 wherein the slant top is provided at an angle of between about 20° and 30° from the horizontal.

27. The currency collecting machine of claim 23 wherein the bill validator extends no more than about 5 centimeters beyond the opening in the bill acceptor access door.

28. The currency collecting machine of claim 23 wherein the rotation mechanism includes a handle which when pulled causes the bill acceptor to rotate between said bill insertion and said cash removal positions.

29. The currency collecting machine of claim 28 wherein the rotation mechanism further includes a bracket mounted to the machine interior and having a first set of pivot mounts for pivotally mounting said handle and a second set of pivot mounts which pivotally mount a cradle for holding said bill acceptor.

30. The currency collecting machine of claim 23 wherein the rotation mechanism includes a bracket which allows the bill acceptor to slide between said bill insertion and said cash removal positions.

31. The currency collecting machine of claim 23 wherein the rotation mechanism includes a pivot mount which allows the bill acceptor to pivot between said bill insertion and said cash removal positions.

32. The currency collecting machine of claim 23 wherein the rotation mechanism includes:

a cradle for holding said bill acceptor, and a linkage mechanism connecting said access door to said cradle such that opening the access door causes the bill acceptor to rotate between said bill insertion and said cash removal positions.

33. The currency collecting machine of claim 23 wherein the rotation mechanism includes:

a cradle for holding said bill acceptor, and a spring loaded damper connecting said cradle to said machine housing.

34. The currency collecting machine of claim 33 wherein the access door is solidly mounted to said bill acceptor such that opening the access door causes the bill acceptor to rotate between said bill insertion and said cash removal positions.

* * * * *